United States Patent [19]

Kilgore

[11] Patent Number: 5,070,941

[45] Date of Patent: Dec. 10, 1991

[54] DOWNHOLE FORCE GENERATOR

[75] Inventor: Marion D. Kilgore, Dallas, Tex.

[73] Assignee: Otis Engineering Corporation, Dallas, Tex.

[21] Appl. No.: 574,815

[22] Filed: Aug. 30, 1990

[51] Int. Cl.[5] ..... E21B 31/00; E21B 19/22; E21B 23/00

[52] U.S. Cl. ..... 166/98; 166/72; 166/77; 166/212

[58] Field of Search ..... 166/98, 212, 120, 319, 166/332, 382, 384, 374, 375, 77, 72

[56] References Cited

U.S. PATENT DOCUMENTS

| | | | |
|---|---|---|---|
| Re. 25,381 | 5/1963 | Brown | 166/134 |
| 2,765,853 | 9/1956 | Brown | 166/134 |
| 2,836,250 | 5/1958 | Brown | 166/212 X |
| 2,901,044 | 8/1959 | Arnold | 166/98 |
| 2,915,126 | 12/1959 | Potts | 166/98 |
| 2,965,175 | 12/1960 | Ransom | 166/98 |
| 2,989,121 | 6/1916 | Brown | 166/46 |
| 3,096,824 | 7/1963 | Brown | 166/210 |
| 3,131,769 | 5/1964 | Rochemont | 166/212 |
| 3,142,339 | 7/1964 | Brown et al. | 166/122 |
| 3,147,809 | 9/1964 | Thomas | 166/212 X |
| 3,211,227 | 10/1965 | Mott | 166/120 |
| 3,223,169 | 12/1965 | Roark | 166/120 |
| 3,233,675 | 2/1966 | Tamplen et al. | 166/120 |
| 3,276,793 | 10/1966 | Crow | 285/137 |
| 3,277,965 | 10/1966 | Grimmer | 166/120 |
| 3,326,292 | 6/1967 | Young et al. | 166/106 |
| 3,329,210 | 7/1967 | Brown | 166/120 |
| 3,338,308 | 8/1967 | Elliston et al. | 166/120 |
| 3,356,145 | 12/1967 | Fredd | 166/224 |
| 3,376,927 | 4/1968 | Brown | 166/35 |
| 3,381,752 | 5/1968 | Elliston | 166/120 |
| 3,422,899 | 1/1969 | Brown | 166/129 |
| 3,425,489 | 2/1969 | Brown | 166/129 |
| 3,454,090 | 7/1969 | Brown | 166/138 |
| 3,497,001 | 2/1970 | Brown | 166/120 |
| 3,599,712 | 8/1971 | Magill | 166/212 |
| 3,658,127 | 4/1972 | Cochran et al. | 166/120 |
| 3,701,382 | 10/1972 | Williams | 166/183 |
| 3,752,230 | 8/1973 | Bernat et al. | 166/98 |
| 3,893,512 | 7/1975 | Carroll et al. | 166/315 |
| 4,133,386 | 1/1979 | Knox | 166/212 X |
| 4,274,486 | 6/1981 | Fredd | 166/250 |
| 4,453,599 | 6/1984 | Fredd | 166/374 |
| 4,844,166 | 7/1989 | Going et al. | 166/379 |
| 4,862,958 | 9/1989 | Pringle | 166/72 |
| 4,928,770 | 5/1990 | Murray | 166/385 |
| 4,928,772 | 5/1990 | Hopmann | 166/386 |

OTHER PUBLICATIONS

"Otis Products and Services", Catalog 5516, Published 9/89 by Otis Engineering Corp., Dallas, TX 75381-9052, pp. 54 & 66.

*Primary Examiner*—Stephen J. Novosad
*Attorney, Agent, or Firm*—Albert W. Carroll

[57] ABSTRACT

A hydraulic well tool for running into a flow conduit of a well on a handling string, such as reeled tubing or jointed pipe, for generating and applying an axial force to an object in the well, the well tool including an anchoring mechanism actuatable by fluid pressure in the handling string for anchoring the well tool in the flow conduit, this well tool further including a piston/cylinder arrangement also actuatable by fluid pressure in the flow conduit for moving the aforementioned object. The object may be a well tool, a sliding sleeve, a fish, or other well tool. The hydraulic well tool may be provided with a suitable device to permit increasing the pressure in the handling string for actuation of the anchoring mechanism and the piston/cylinder arrangement. Devices suitable for such purpose include a flow restrictor, ball and seat, velocity check valves, plugs, or the like devices. The displacement of such object is brought about hydraulically while the well tool is anchored in the flow conduit and without axially stressing the handling string. The anchoring mechanism includes piston type anchor members each formed with a sinusoidal seal ring recess at its inner end for increasing the stroke of the anchor members, and with a recess running across the inner face of the anchor member in a direction parallel to the longitudinal axis of the well tool to avoid obstructing the longitudinal body bore.

27 Claims, 4 Drawing Sheets

DOWNHOLE FORCE GENERATOR

BACKGROUND OF THE INVENTION

1. Field of the Invention

This invention relates to downhole well tools and more particularly to devices for running into and out of a well on a handling string for generating a force for moving an object in the well bore after temporarily anchoring the lower portion of such handling string in the well.

2. Related Art and Information

It has been common practice to use hydraulically actuated piston/cylinder arrangements for applying a force to accomplish a remote task. Well packers, well safety valves, well pumps, and the like have been actuated at downhole locations by supplying pressurized fluid thereto from the surface through a fluid conduit, or control line. Oftentimes it is desirable to slide a sleeve valve which is stuck, or move an object which is lodged in the well. This may involve moving the sliding sleeve valve up or down, or both; and may involve moving the lodged object up or down, or both. Such work may ordinarily require an expensive rig and a sturdy handling string.

Wire line and wireline tools have been used only for light work of this type, and reeled tubing has been used also. Rigs for wire line and reeled tubing are more highly mobile than are larger rigs, and they are much less expensive. However, wire line is of limited tensile strength, it is very flexible and cannot transmit a pushing force, and requires jars for moving objects which do not move easily. Similarly, reeled tubing is of limited weight and tensile strength, and since it is relatively flexible it can apply only light pulling or pushing forces. Therefore, wireline equipment cannot be used effectively for many such jobs, and neither can reeled tubing. Wireline equipment cannot be used in horizontal wells since it is dependent upon the force of gravity not only for moving the tools and wire into the well, but for operating the jars for generating impacts downhole in response to manipulation of the wire line at the surface. Reeled tubing, while having greater strength and rigidity than wire line, and can be used in horizontal well operations, is nevertheless very limited in both pulling and pushing, particularly the latter, since it is subject to great drag which hastens its failure in column loading.

It, therefore, has been desirable to be able to perform such push or pull operations using reeled tubing. It has been especially desirable to perform such push and pull operations in horizontal and slanted or curved well bores.

Reeled tubing can carry considerable fluid pressure. The present invention provides hydraulic devices which can be attached to a reeled tubing, run into a well, even a horizontal well until the object to be moved is engaged. The reeled tubing is then pressurized to anchor the hydraulic device in the well and is further pressurized to generate an axial force which is applied to the object, tending to move the same.

Examples of hydraulically actuated anchoring devices as well as piston/cylinder arrangements are found in the U.S. patents listed below. There is also found patents teaching use of reeled tubing for shifting sleeve valves. (One copy each of the most pertinent patents are being submitted with this application.)

| U.S. Pat. Nos. | | | |
|---|---|---|---|
| RE. 25,381 | 2,765,853 | 2,989,121 | 3,096,824 |
| 3,142,339 | 3,221,227 | 3,223,169 | 3,233,675 |
| 3,276,793 | 3,277,965 | 3,326,292 | 3,329,210 |
| 3,338,308 | 3,356,145 | 3,376,927 | 3,381,752 |
| 3,422,899 | 3,425,489 | 3,454,090 | 3,497,001 |
| 3,599,712 | 3,658,127 | 3,701,382 | 3,893,512 |
| 4,274,486 | 4,453,599 | 4,862,958 | 4,928,770 |
| 4,928,772 | | | |

U.S. Pat. No. 2,765,853 and its reissue, Patent Re. 25, 381 teach use of pressure responsive hold-down members for preventing the upward displacement of a packer by a fluid pressure therebelow greater than that thereabove. These hold-down members 16 are slidable in lateral bores and are forced outward by the greater pressure below the packer. The teeth **16*b*** of these members bitingly engage the pipe exterior of the packer and, the greater the differential pressure tending to lift the packer, the greater these members anchor the packer. (Col. 3, lines 32–60 and Col. 5, lines 43–64.)

Other patents showing hold-down members activated by fluid pressure from below a packer are U.S. Pat. Nos. 2,989,121; 3,096,824; 3,142,339; 3,211,227; 3,223,169; 3,233,675; 3,276,793; 3,277,965; 3,326,292; 3,329,210; 3,338,308; 3,381,752; 3,422,899; 3,425,489; 3,454,090; and 3,701,382.

Other similar hold-down teachings are found in the following patents.

U.S. Pat. No. 3,497,001 which issued Feb. 24, 1970 to Cicero C. Brown shows use of hold-down members 32 in a tubing anchor A used in a pumping well. The column of liquid in the well tubing T forces the hold-down members outward into biting engagement with the surrounding casing (col. 3, line 75, et seq.).

U.S. Pat. No. 3,376,927 which issued to Joe R. Brown on Apr. 9, 1968 teaches use of hold-down members 63 for anchoring a cutting tool in axial position by pressurizing the pipe string 13. (See col. 3, lines 56–67.)

U.S. Pat. No. 3,599,712 which issued on Aug. 17, 1971, to Charles W. Magill discloses use of hold-down slips 28 energized by pressurized fluids in bore 22 for holding a tubing fixed in the well bore. (See col. 2, lines 67–75.)

U.S. Pat. No. 3,658,127 which issued to Chudleigh B. Cochran and Phillip H. Manderscheid on Apr. 25, 1972, teaches again the well-known practice of pumping a ball (B) down a well tubing T-2 and allowing it to become seated below a packer, then pressuring up the tubing to actuate the hydraulically set packer to its set condition. (See col. 5 beginning at line 69.)

U.S. Pat. No. 4,862,958 which issued to Ronald E. Pringle on Sept. 5, 1989 discloses a fluid power actuated actuating tool, this tool being run on the end of reeled tubing through which a small flexible tubing 14 passes. Fluid pressure is supplied from the surface to this actuating tool 10 to actuate the slips 28 and maintain them engaged to retain the tool anchored in the tubing. Nitrogen is supplied from the surface through the bore of the reeled tubing 12 to actuate power actuating means 54. The tool can deliver jarring impacts (col. 4, lines 20–33) or can provide a constant pressure stroke (col. 4, line 62 through col. 5, line 2).

U.S. Pat. No. 4,274,486 issued on June 23, 1981 to John V. Fredd and discloses a piston 26 slidable in the bore (cylinder) of member 28 of telescoping joint 23. Pressure in the annulus 29 can move the piston upward if the difference between the annulus and the tubing pressure is sufficient. Thus, this piston/cylinder can be operated remotely from the surface by controlling the differential pressure. (Col. 4, lines 21–35.)

U.S. Pat. No. 4,453,599 which issued to John V. Fredd on June 12, 1984 discloses in FIG. 1 the use of a piston/cylinder 35 downhole in a well to actuate a sleeve valve 14 located just above the packer 13. The valve is controlled by tubing pressure. Pressuring the tubing 36 causes the piston 41 to move upward and open the valve to permit well fluids to flow into the annulus surrounding the tubing. Reducing the tubing pressure allows weight of the piston and a length of pipe attached thereto to move down and close the valve. Other forms of valves are disclosed, all using a similar valve and utilizing a differential pressure across the piston for its operation, this differential may involve changes in tubing or casing pressure.

U.S. Pat. No. 4,862,958 (mentioned earlier) also discloses as a part of its power actuating means 54 a piston 80, FIG. 2, which is moved downward in housing 18 by pressurized nitrogen supplied through flexible tubing reeled tubing 12. A similar piston/cylinder, actuator 54*a* is illustrated in FIGS. 5 and 6.

U.S. Pat. No. 3,356,145 which issued to John V. Fredd on Dec. 5, 1967 discloses in FIG. 2 a piston/cylinder 31 which utilizes pressure in the well annulus 442 to lift a floating portion of pipe 32 to an upper position to hold the safety valve 35 open. When pressure in the annulus falls below a predetermined level the floating pipe will be allowed to move down and close the valve. (See col. 15, line 72 to col. 16, line 48.)

U.S. Pat. No. 4,928,770 which issued on May 29, 1990 to Douglas J. Murray discloses use of reeled tubing apparatus 10*b* for shifting sliding sleeves 101 in wells. Also disclosed is the use of a piston 10*a* on the reeled tubing near the shifting tool. When the shifting tool is engaged with the sliding sleeve the piston will be in a close-fitting portion PT-1 of the tubing. The sleeve is shifted up or down by moving the reeled tubing 11. When attempting to shift the sleeve down and it cannot be moved by the reeled tubing alone, the tubing pressure above the piston can be increased to cause the piston to aid in the down shifting of the sleeve. This procedure can be used only for down shifting (Col. lines 58–62). U.S. Pat. No. 4,928,772 which issued to Mark E. Hopmann on May 29, 1990, also contains approximately the same subject matter as does U.S. Pat. No. 4,928,770 just mentioned, but does not disclose the piston.

U.S. Pat. No. 3,893,512 which issued to Albert W. Carroll and Phillip S. Sizer on July 8, 1975 discloses a sleeve valve near the production zone in a well which will close should the tubing be severed thereabove. In certain embodiments, the system is resettable to make possible periodic testing t assure their operability. Piston/cylinder arrangements are disclosed for such resetting. In FIG. 9, casing pressure acting beneath piston 101 holds it up in the cylinder to permit production. Loss of pressure below the piston permits gravity to move the piston down. If the piston and its tubing section TS has dropped, pressuring the casing will lift them back to their upper position. In FIG. 10, which is similar to FIG. 9, the piston is lifted by pressure conducted to the lower end of the cylinder through small conduit CFL. In FIGS. 14 and 15, a piston/cylinder arrangement is illustrated wherein the tubing is plugged at 250 by a plug 251 between the valve V and the cylinder 221, and a port 234 is provided just below piston 232. Pressure applied to the upper portion T of the tubing passes through this port and lifts the piston in the cylinder to, thus, open valve V.

There was not found in the prior art a force generator for use with a handling string of reeled tubing or light jointed pipe which can apply an axial force to an object in a well flow conductor for pushing or pulling such object to dislodge and/or retrieve the same while the handling string is anchored in the well flow conductor, the anchoring and the force generating being accomplished by fluid pressure conducted to the force generator through the handling string.

The present invention is an improvement over the known prior art and is simple and economical to manufacture and operate. Furthermore, it is very useful in horizontal wells.

SUMMARY OF THE INVENTION

The present invention is directed toward a device for generating and applying an axial force to an object in a well flow conductor, the device including a force generator having a body, one end of which is connectable to a handling string and the other end of which is connectable to an object engaging tool, the body further comprising a cylinder, a piston reciprocable in the cylinder, and pressure activated anchoring members for anchoring the device in the well flow conductor.

One embodiment of this invention is useful in applying a pulling force to an object in a well; a second embodiment is useful in applying a pushing force to an object in a well; and a third embodiment is useful in selectively applying a pulling or pushing force to an object during a given trip of the device into a well. Each of these forms of the invention may include a flow resistor below the piston/cylinder and/or a plug for closing the flow passage through the device in that area, or may utilize a ball closure carried in the device or dropped thereinto when desired, or a velocity-type check valve.

It is therefore one object of this invention to provide a device for running into a well on a light handling string for shifting other devices axially in the well while the handling string is held against shifting axially.

Another object of this invention to provide a device to be run on a light handling string and to be anchored in the well for applying an axial force to an object in the well flow conductor.

Another object is to provide such a device which is anchored in the well responsive to pressuring the handling string for applying a pulling force to an object in a well.

Another object is to provide such a device having a piston/cylinder for applying a pushing force to an object in a well.

Another object is to provide such a device for applying a pulling or a pushing force to an object, the choice can be made after the device is in the well.

Another object is to provide such device having a shifting tool on its lower end for engaging a sliding sleeve in a well.

Another object of this invention is to provide such a device having a fishing tool on its lower end for engaging an object in a well and for removing the same therefrom.

Another object is to provide a device of the character described and having means thereon for lockingly engaging the well flow conductor and being activated by fluid pressure in the handling string.

Another object is to provide a device of the character described in which a flow restrictor provides back pressure for actuating the anchoring mechanism.

Another object is to provide such a device in which a ball and seat closes the flow path through the device at a location downstream of the piston/cylinder.

Another object is to provide such a device having a velocity check valve downstream of the piston/cylinder.

Another object of this invention is to provide methods including the steps of providing a device having at least one piston/cylinder, an anchoring mechanism thereabove; flow controlling means therebelow, and an engagement tool on its lower end, running the device into a well on a handling string, engaging with the engagement tool the object to be moved in the well, pressuring the handling string to actuate the anchor mechanism to anchor the device in the well and then actuating the piston/cylinder to apply an axial force to the object, and relieving the pressure from the handling string and withdrawing the handling string and the device from the well.

Another object is to provide such methods wherein the device may apply a pulling force, a pushing force, or may selectively apply either a pulling force or a pushing force.

Another object is to provide systems utilizing devices and/or methods of the character described for installing or pulling well tools, shifting sliding sleeves, moving objects lodged in well flow conductors, pushing cleaning tools or drill bits, or the like.

Other objects and advantages may become apparent from accompanying drawing wherein:

DESCRIPTION OF THE PREFERRED EMBODIMENTS

Figure 1:
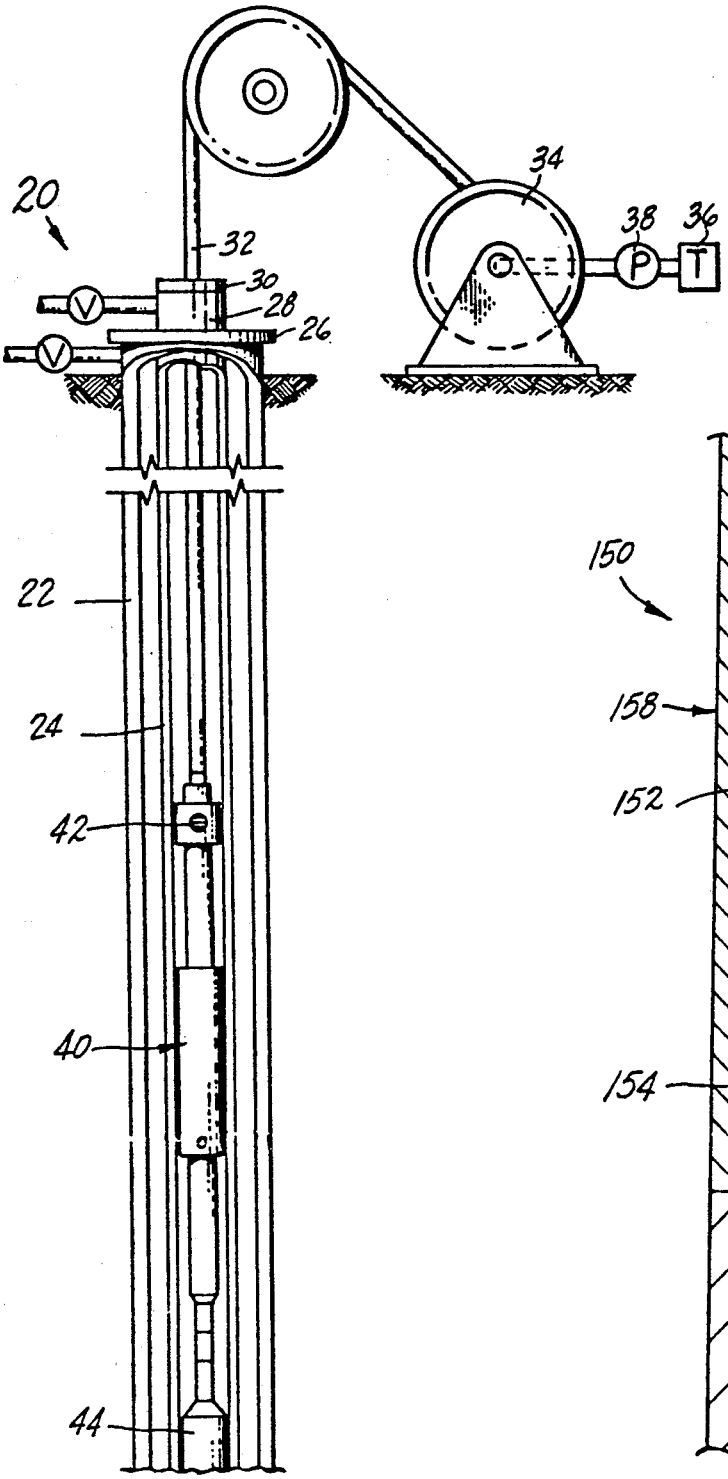
FIG. 1 is a schematical view showing a well and a well tool suspended therein on a reeled tubing.

Referring now to FIG. 1, it will be seen that a well 20 includes a casing 22 having a tubing 24 disposed therein and a wellhead 26 closing the upper end of the casing about the tubing. Above the wellhead is a representation of a tree as at 28 and a blowout preventer or stuffing box 30 atop thereof through which a handling string such as reeled tubing 32 may be forced into and out of the well as by well-known injection means (not shown). The reeled tubing 32 is wound on and off the reel 34 by drive means (not shown) and suitable liquid from tank 36 is received by pump 38 and forced into reeled tubing 32 as desired and in the usual manner. The well tool 40 is adapted to be anchored by pressure actuated slip means 42 and to utilize pressure to generate an axial force through an engaging tool 44 for moving an object (not shown) in the well. Such object to be moved may be a sliding sleeve valve, drill, washing tool, stuck tool, setting tool, pulling tool, fishing tool, impression block, or other tools or devices which might require axial force for their operation, dislodgement, or other purpose.

While FIG. 1 shows the device of this invention being run on reeled tubing, it could also be run on a jointed pipe string; and while the well 20 is shown to have a vertical bore, the device of this invention can be used in deviated well bores and in horizontal wells.

Figure 2:
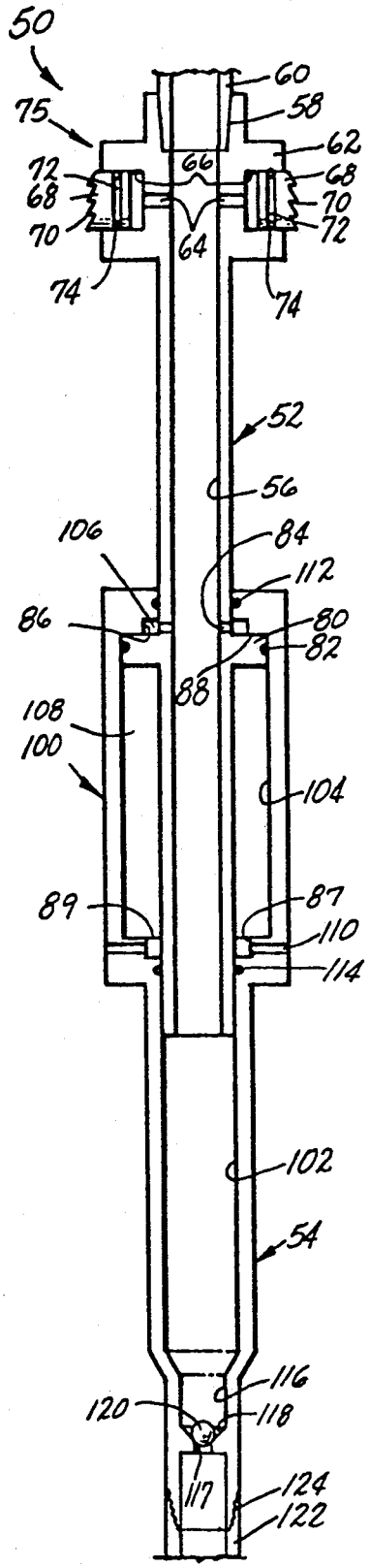
FIG. 2 is a schematical view of a well tool of the invention for applying a lifting force to an object in the well.

Referring now to FIG. 2, it will be seen that the first embodiment of this invention is indicated generally by the reference numeral 50. This device which may be called a force generator comprises an upper tubular body 52, and a lower tubular body 54.

The upper tubular body 52 is provided with a bore 56, suitable connection means such as a thread as at 58 for attachment to a handling string 60 which may be any suitable tubular handling string such as reeled tubing or jointed pipe. The upper tubular body is enlarged in outside diameter as at 62 and is provided with a pair of opposed passages 64, and these passages are enlarged to form a pair of larger bores 66 in which a pair of piston slips 68 are slidable between a retracted position in which their teeth 70 do not protrude beyond the periphery of the enlargement 62 and an expanded position in which their teeth bitingly engage the inner wall of the surrounding well flow conductor, such as the well tubing 24 seen in FIG. 1.

Each piston slip 68 is provided with a circumferential-type groove 72 close to its inward end in which a resilient seal ring such as O-ring 74 is installed for preventing leakage of fluids about the slip.

It is readily understood that fluid pressure in the handling string 60 and, therefore, in bore 56 of the upper tubular body will be communicated through lateral passages 64 into the opposed bores 66 and there will act against the inner end faces of the slips 68 to apply an outward bias thereto. In this manner, pressurization of the handling string will pressurize the force generator 50, and this will result in the slips being expanded into biting engagement with the surrounding well conduit which will lock the force generator at that location in the conduit. It follows that bleeding the pressure from the force generator will release this anchoring mechanism 75 since, for lack of pressure holding them expanded, the slips 68 will relax and springs (not shown in FIG. 1, but shown in FIG. 9) will retract them fully.

The upper tubular body 52 is provided with a sizeable piston 80 a spaced distance below the anchoring mechanism 75 and this piston carries a seal ring 82 in a suitable annular groove. A lateral passage 84 is provided through the wall of this upper body 52 just above piston 80 for a purpose soon to be made clear.

The lower tubular body 100 is formed with a bore 102 which has its upper portion enlarged as at 104 to provide a cylinder in which piston 80 is slidable. Piston 80 divides the cylinder cavity into a power chamber 106 above the piston and an exhaust chamber 108 below the piston. The lateral passage 84 conducts pressurized fluid from the bore 56 of the upper body into the power chamber 106 to expand the same for lifting the lower body 54 relative to the upper body 52.

That portion of the upper body 52 which extends below piston 80 telescopes into bore 102 of the lower body 54 as shown to provide stability and alignment to prevent binding which would otherwise cause malfunctioning of the device.

Cylinder 100 is provided with an exhaust port such as port 110 near its lower end to provide an escape for the fluids displaced from the exhaust cylinder when the lower body moves up relative to the upper body. The port 110, then, permits the exhaust chamber to breathe as necessary due to relative movement between the piston and the cylinder.

It is seen that a pair of seals 112 and 114 are carried in suitable internal annular grooves formed at opposite ends of the cylinder 104 for sealing between the upper end of the cylinder and the exterior of the upper body above the piston 80 and lateral passage 84, and between the lower end of the cylinder and the exterior of the upper body below the piston 80.

The bore 108 of the lower body 54 is reduced at its upper and lower ends as at 86 and 87 to provide upper and lower stop shoulders as at 88 and 89 to be engaged by the piston for the purpose of limiting its relative movement in the cylinder bore 108. The reduction in bore 108 to form these stop shoulders also provides annular recesses which will allow pressure to be communicated through port 84 above the piston and port 110 at the lower end of the cylinder even though the piston may be engaged with either of the stop shoulders.

The lower body 54 may have its bore 102 reduced as at 116, and a suitable restriction 117 which may be in the form of suitable seat 118, as shown, is provided. The seat will accept a ball closure such as ball 120 which can be run in the force generator, but may preferably be dropped into the handling string later and allowed to fall by gravity or to be pumped down until it becomes seated and closes the passage 117 through seat 118. When fluids are pumped down the handling string, such fluids may be allowed to return around the exterior of the handling string but within the well tubing 24 (FIG. 1). Before the ball 120 is engaged on seat 118, such fluids may be circulated as just described. However, if the differential pressure created by the restricted bore 117 exceeds a predetermined value, the piston slips 68 will be expanded to anchoring position. Of course, when the ball 120 closes bore 117 through the seat 118, pressure may be readily built up in the handling string for expanding the piston slips and then actuating the piston/-cylinder arrangement.

In use, the force generator 50 is provided with an engagement tool 122 on its lower end and is lowered into a well, such as the well tubing 24, until the object to be moved is engaged. The ball 120 is dropped into the handling string and pumped down or allowed to gravitate to a position of engagement with the seat 118. The handling string is pressurized to activate the piston slips to anchor the force generator in the tubing, or well flow conductor, and further pressuring then causes the power chamber 106 above piston 80 to expand, lifting the lower body and the engagement tool 122 attached thereto, as well as the object with which the engagement tool is engaged. Should the object move some but still too difficult to move by pulling on the handling string, pressure is bled from the handling string, the handling string is lifted to extend the force generator and place it in the condition seen in FIG. 2, after which it may be pressurized again. Thus, the pulling operation may be repeated as many times as necessary to free the object for withdrawal from the well.

Figure 3:
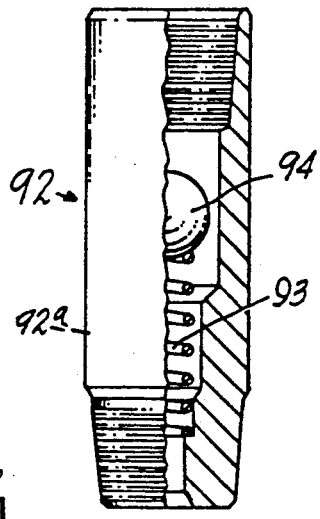
FIG. 3 (PRIOR ART)
FIG. 3 is a longitudinal schematical view partly in elevation and partly in section showing one form of prior art velocity check valve.

In FIG. 3 there is illustrated a simple form of prior art velocity check valve which could be used in device 50 in place of the seat 118 and ball 120. In FIG. 3, the velocity-type check valve is indicated generally by the reference numeral 92. This device comprises a sub **92*a* having a reeled spring 93 with its lower end pressed into a snugly fitting bore to retain it in position, as shown. The spring holds a ball 94 high above the annular seat 95**, as shown. Fluids may be forced downward through the check valve, but such flow creates a differential pressure across the ball, tending to force the ball down and compress the spring. When the rate of flow reaches a predetermined value the ball will become seated and will stop all such flow through the seat. When the ball becomes thus seated pressure builds quickly thereabove. When, however, pressure above the ball is reduced below a predetermined pressure, the spring will force it upward and from the seat.

In this form of velocity check valve, the ball may be dropped when needed, or it may be placed in the force generator at the surface before it is run into the well.

Figure 4:
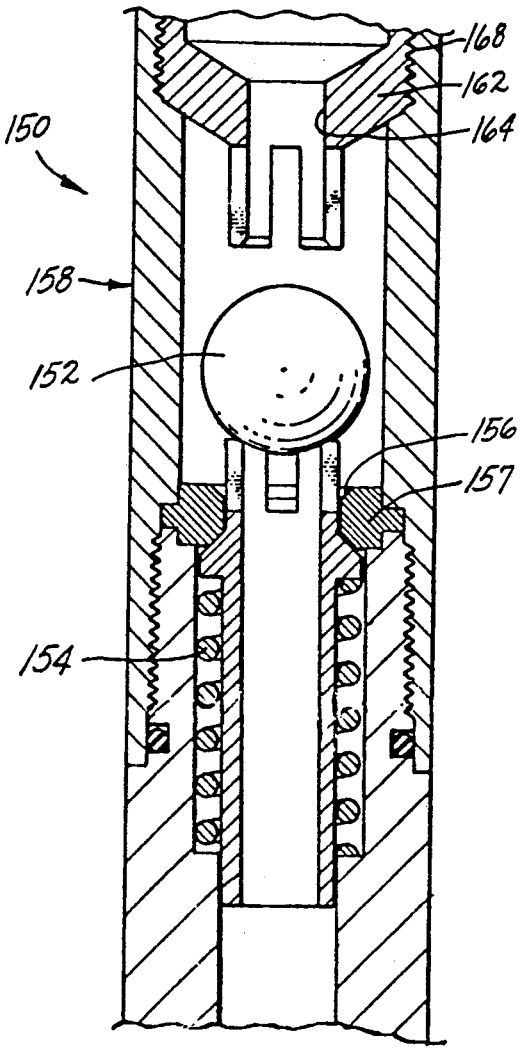
FIG. 4 (PRIOR ART)
FIG. 4 is a schematical view in longitudinal section showing another form of prior art velocity check valve.
Figure 5:
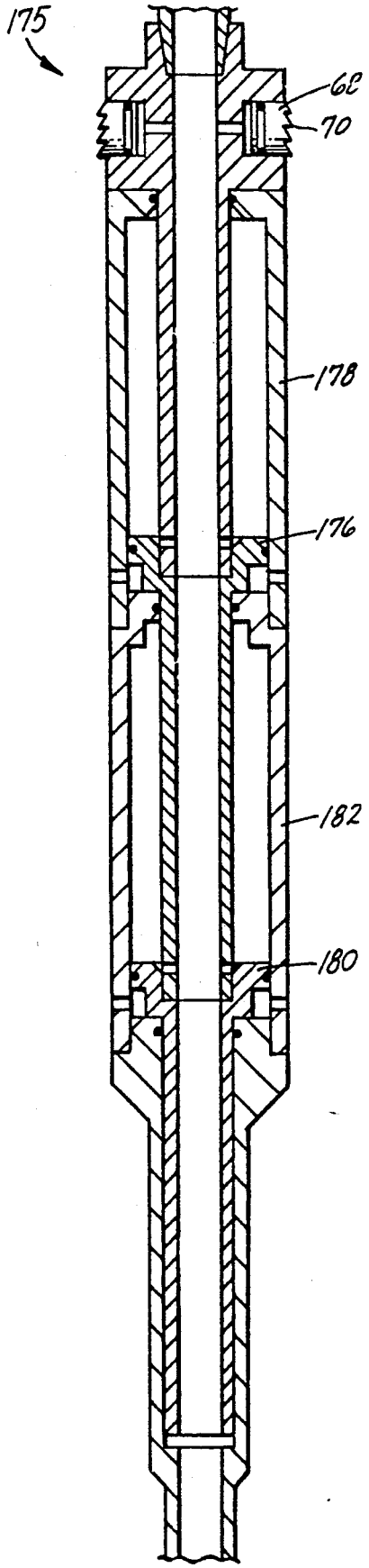
FIG. 5 is a schematical view in longitudinal section showing a well tool similar to that of FIG. 2 but having a compound piston/cylinder arrangement.

An alternate modified form of velocity check valve is seen in FIG. 4 and is indicated generally by the reference numeral 150. When the downward flow rate through this check valve increases to a value at which the drop in pressure across the ball 152 is sufficient to compress the spring 154 the ball will be moved down to engage the seat surface 156 of seat 157 and will prevent further flow. Of course, when such pressure difference subsides, the spring will unseat the ball and permit further flow through the seat. The housing 158 may be provided with a thread 160 for receiving a retainer 162 having a bore 164 and with prongs or other means for preventing the ball from plugging the bore 164 by seating against the lower end of the retainer. If desired, the retainer may be omitted, in which case the ball may be dropped into the handling string later when needed.

Where greater lifting forces are to be generated, a force generator similar to that of the first embodiment (50) but having multiple pistons can be used. Such a force generator is illustrated in FIG. 5 where it is indicated generally by the reference numeral 175. This second form of force generator has an upper piston 176 and an upper cylinder 178 as well as a lower piston 180 and a lower cylinder 182. Because it has 2 pistons rather than one, as in the first form, it will generate approximately twice the axial force. It, of course, would be considerably longer than the single-piston form of FIG. 2 for the same piston stroke.

It is understood that the force generators 50 and 175 of FIGS. 2 and 4, respectively, have the teeth 70 of the piston slips slanted downward, as shown, such that they are efficient in supporting the load to which they are subjected. If such piston slips are to be used in a force generator used for pushing downward, the same piston slips may be used, but they must be rotated 180 degrees so that their teeth 70 will slant upward rather than downward.

Figure 6:
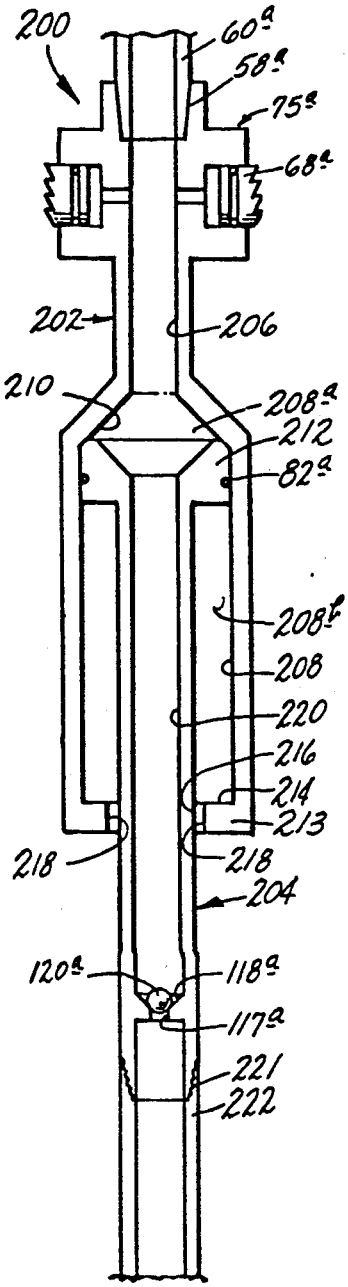
FIG. 6 is a schematical view similar to that of FIG. 2 but showing another embodiment of this invention for applying a downward force to an object in a well.

A third form of force generator is seen in FIG. 6 where it is indicated generally by the reference numeral 200. It is seen that the device 200 comprises an upper tubular body 202 and a lower tubular body 204.

The upper tubular body is provided with connecting means such as thread 58*a* at its upper end for attachment to a handling string 60*a* and with anchoring means such as anchoring means 75*a* near its upper end which may be exactly like the anchoring means 75 of the device 50 previously described with the exception that the piston slips 68 are rotated 180 degrees, as shown, to enable them to support the device against axial displacement when applying a pushing (downward) force.

The bore 206 of the upper body 202 is enlarged at its lower portion as at 208 to provide a cylinder, as shown. This change in bore size provides a downwardly facing shoulder as at 210 which limits upward movement of a piston 212 relative thereto, this piston being formed on the upper end of the lower body 204 and being slidable in the cylinder.

The piston 212 carries a resilient seal ring 82*a* in a suitable external annular recess and seals between the piston and the inner wall of cylinder 208 dividing the cylinder into a power cylinder 208*a* above the piston and an exhaust cylinder 208*b* therebelow.

The bore 208 of the cylinder is reduced at its lower end to provide an internal flange 213 providing an upwardly facing shoulder 214 for limiting downward movement of piston 212 in cylinder bore 208. This internal flange has a opening as at 216 which is a free sliding fit about the lower body and slots 218 provide outlets for the exhaust chamber 208 below the piston 212. Instead of slots 218, ports could be formed in the cylinder, if desired.

The lower body 204 is provided with a bore 220 having a restriction 117*a* surrounded by a seat 118*a* which may be used with a ball such as ball 120*a* to create an increase in pressure thereabove for activating the anchoring means 75*a* as before explained. The ball can be run with the device 200, or can be dropped into the handling string 60*a* when needed. The ball and seat of device 200 may be exactly like the ball and seat of device 50 of FIG. 2. Further, the device 200 may be equipped with a velocity check valve such as that seen in FIG. 3 or 4, if desired.

In use, a suitable push tool, such as a blind box, fishing tool, pulling tool, or the like, indicated by the reference numeral 222 is attached to the lower end of lower body 204 and the force generator 200 is attached to the handling string 60*a* and lowered into the well until the push tool 222 comes to rest atop the object to be pushed. Setting down of the weight of the handling string upon the push tool will cause the cylinder 208 to telescope over the lower body 204 until the downwardly facing shoulder 210 engages the piston 212 as shown in FIG. 6. The ball 120*a* is used to close the bore below the lower body and the handling string is pressurized to expand the piston slips 68*a* to position anchoring the device in the tubing, and is further pressurized to apply a greater force to the upper side of the piston 212 and, thus, generate a great downward force against the object to be pushed. If the object moves but is still not free and needs to be moved farther, it may be necessary to bleed pressure from the handling string and the force generator, lower the handling string and the upper body 52 of the force generator to again place the device 200 in the retracted position shown in FIG. 6. The handling string is then pressurized as before to effect another push stroke. In this manner, the force generator 200 can be stroked as many times as necessary.

Figure 7:
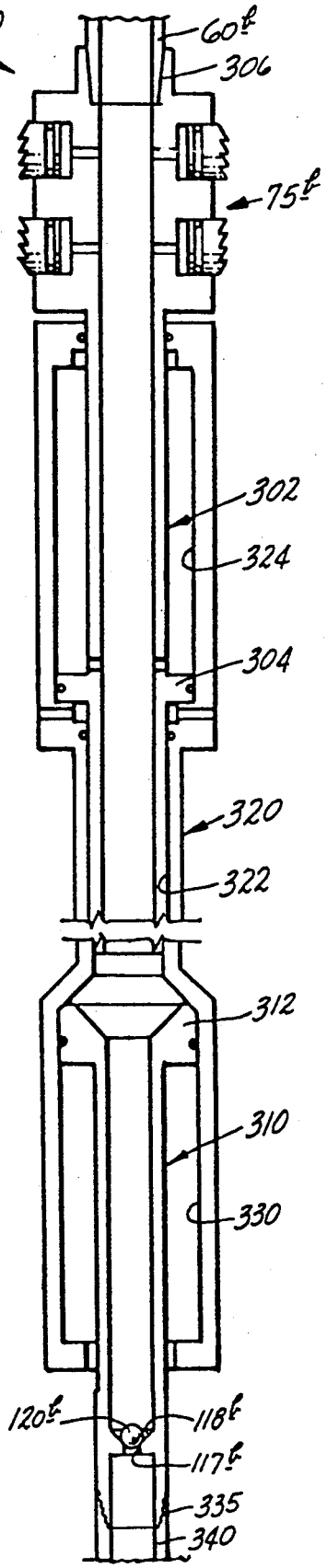
FIG. 7 is a schematical view similar to that of FIG. 2 but showing a further embodiment of this invention which can selectively apply either a lifting force or a downward force to an object in a well.

Referring now to FIG. 7, it will be seen that a fourth embodiment of this invention is illustrated and is identified by the reference numeral 300. This force generator is capable of applying axial forces in either direction. Therefore, it can be used to pull or to push, as desired, with no need to withdraw the handling string from the well merely to exchange a pull-type force generator, such as device 50 or 175, for a push-type force generator, such as device 200.

The upper portion of device 300 resembles the device 50 of FIG. 2 in that it includes an upper body 302 having a piston 304 near its midsection, a thread at its upper end as at 306 for attachment to handling string 60*b*, and anchoring means 75*b*. This anchoring means 75*b* functions exactly like the anchoring means 75 and 75*a* previously described. It is noticed that this anchoring means has twice as many piston slips and that half of them have their teeth slanted downward and the other half have their teeth slanted upward. Thus, they are effective to anchor the force generator in place when a pull force is applied to an object and/or when a push force is applied to an object.

The lower portion of the device 300 resembles that of the device 200 of FIG. 6 in that it has a lower body 310 having a piston 312 at its upper end and having a bore 314 with a restriction 117*b* below the piston, a seat 118*b* surrounding such restriction, and a ball 120*b* for engaging that seat and closing its bore.

An intermediate body 320 has its bore 322 enlarged near its upper end to form a cylinder bore 324 in which upper piston 304 is received for sliding movement therein, and bore 322 is similarly enlarged near its lower end to provide a cylinder bore 330 in which lower piston 312 is received for sliding movement therein. A thread 335 is provided at the lower end of the lower body 310 for attachment of a suitable engaging tool, such as tool 340.

When the combination force generator 300 is used to apply an axial pulling force to an object, the upper piston and cylinder is actuated while the lower piston and cylinder do nothing. Conversely, when the combination device is used to apply an axial pushing force to an object, the upper piston and cylinder do nothing. This, then, renders the combination device simple and easy to operate. To apply a pushing force, the weight of the handling string is used to collapse both cylinders (see FIG. 6), then pressurization of the handling string and device 300 is used to activate the anchor means 75*b* and to move the lower piston 312 down to push the object to be moved. The upper piston/cylinder 304/324 remains collapsed as seen in FIG. 7. On the other hand, to apply an axial pulling force, the object to be moved is engaged and the handling string is lifted to extend both cylinders. Then, pressurization of the handling string is utilized to operate the upper piston cylinder. The lower piston/cylinder 312/330 will remain extended while the upper piston/cylinder retracts to exert the pulling force.

Thus, it is seen that the push-pull operations are never in conflict in using the combination device 300. When pulling, the push portion is idle; when pushing, the pull portion is idle.

Figure 8:
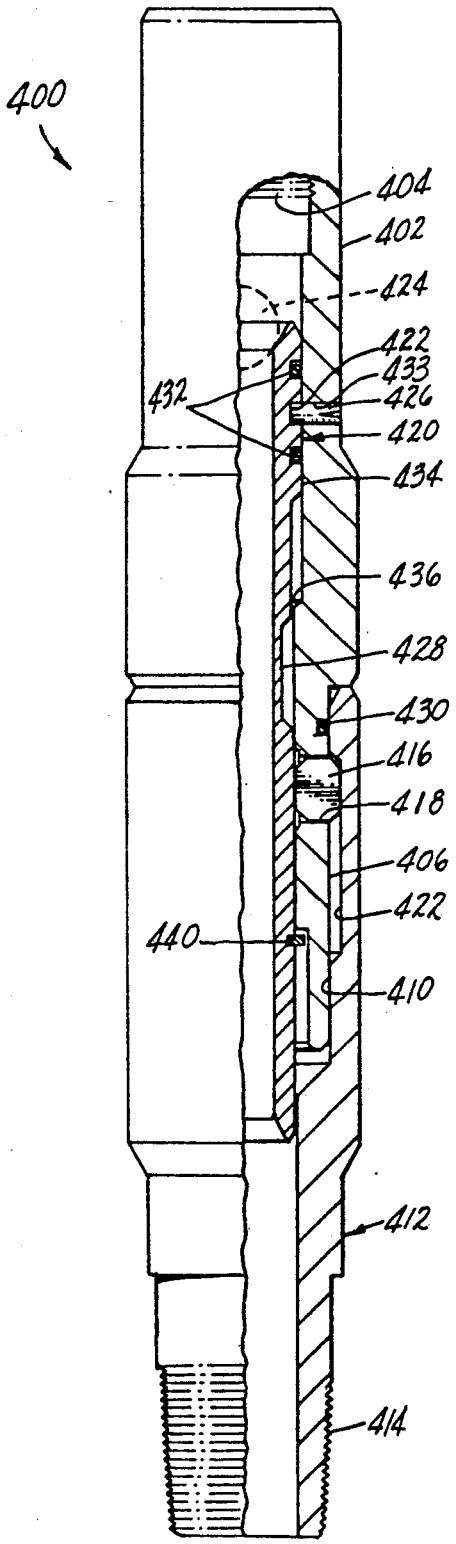
FIG. 8 (PRIOR ART)
FIG. 8 is a schematical view, partly in section and partly in elevation, showing a disconnect device which may be included in certain embodiments of this invention.

Referring to FIG. 8, it is seen that a prior art remotely operated disconnect device is shown and is indicated generally by the reference numeral 400. This device is useful as a safety joint when the engaging tool attached to the lower end of a force generator is gripping an object that will not pull free or release therefrom.

The device 400 has an upper sub 402 having threads 404 at its upper end and has its lower reduced end 406 telescoped into the upwardly opening socket or receptacle 410 at the upper end of lower sub 412. This sub has a thread 414 on its lower end for attachment to the engaging tool. The upper sub 402 carries a lug 416 in a lateral window 418, and this lug is supported by a shiftable sleeve 420 against disengagement from the internal lock recess 422 of the lower sub. The lug can move inwardly only when sleeve 420 is shifted down as by dropping a ball 424 and applying enough pressure thereabove to break the shear pin 426. When this sleeve is then moved down, its recess 428 becomes aligned with the lug which then moves freely inwardly thereinto to unlock the connection. The upper sub can then be pulled free of the lower sub.

An O-ring 430 seals the connection. A pair of O-rings 432 bridge the shear pin hole 433. The enlarged upper portion 434 of the sleeve will engage the upwardly facing shoulder 436 to assure that the sleeve will be retrieved with the upper sub. The snap ring 440 aids in installing the shear pin 426 by helping to align the shear pin recess 422 of sleeve 420 with the shear pin hole 433.

Figure 11:
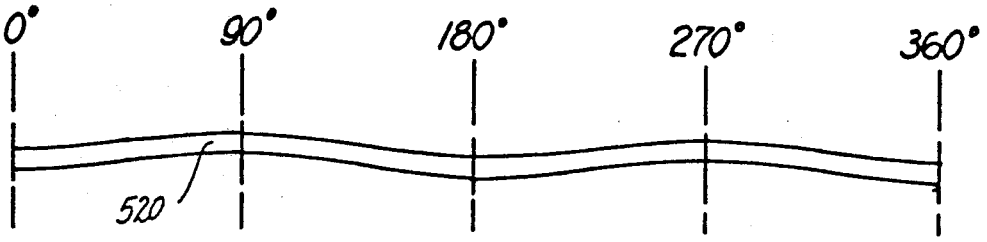
FIG. 11 is a development view showing the sinusoidal seal ring recess of the piston slips seen in FIG. 10.
Figure 9:
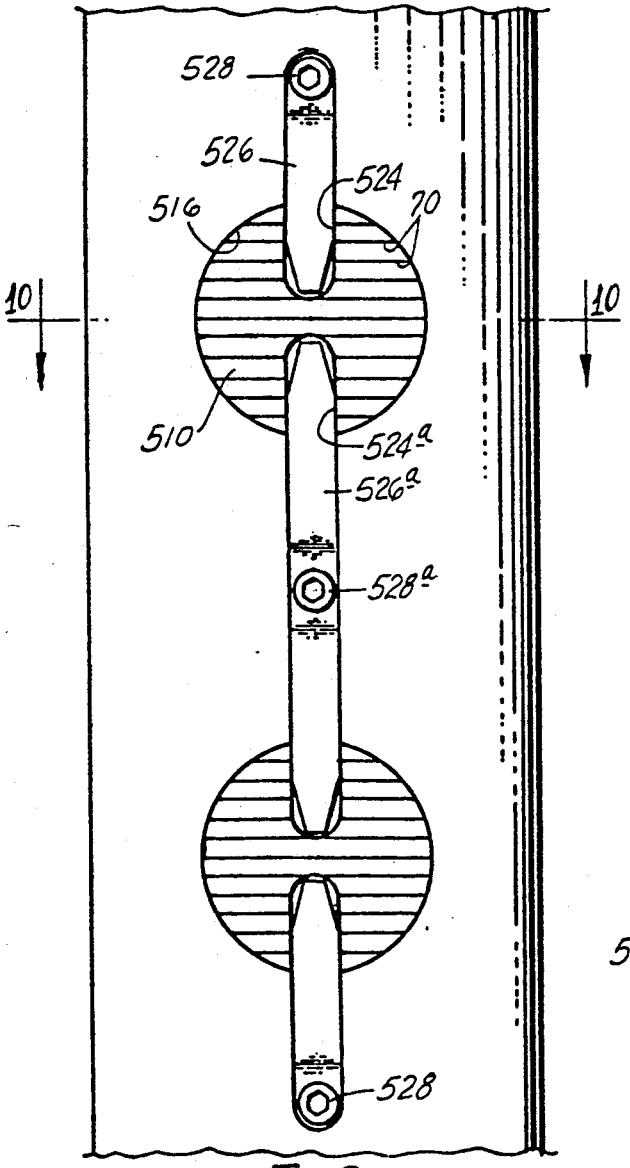
FIG. 9 is a fragmentary longitudinal view in elevation showing a pressure-actuated anchoring device which may be included in certain embodiments of this invention.
Figure 10:
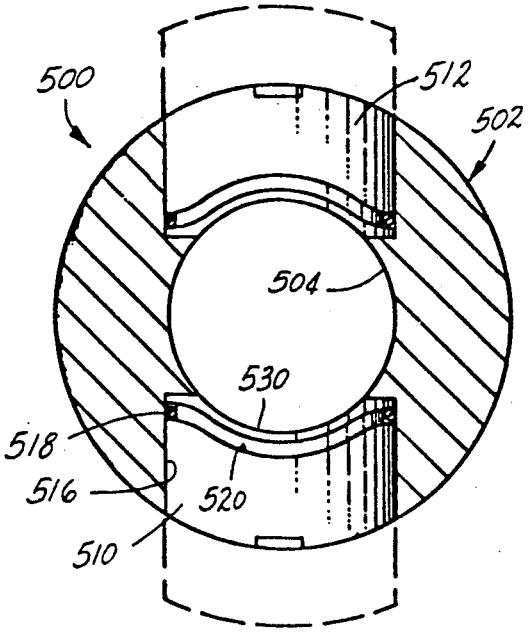
FIG. 10 is a cross-sectional view taken along line 10—10 of FIG. 9.

Referring now to FIGS. 9–11, it is seen that an anchoring device is illustrated and is indicated generally by the reference numeral 500. Anchoring device 500 comprises a tubular body 502 having a bore 504 and which may be formed integral with one of the force generators just described and indicated by the reference numerals 50, 175, 200 or 300 of FIGS. 2, 5, 6, or 7, respectively, but may preferably be made separately and then attached to the upper end of such device by suitable means such as by threads, a weld, or other suitable connection. The anchor device 500 would be formed with suitable connection means at its upper end for attachment to a handling string by which it would be run into and withdrawn from a well. Such connection means would generally be a thread, which could also be used for attaching the force generator to a string of heavy-wall pipe, such as jointed pipe. However, the force generators will likely be used extensively with reeled tubing, in which case a special connector (not shown) is recommended for use on the reeled tubing in order to secure it firmly to the force generator.

The anchor device 500, as shown, is provided with four anchor members such as opposed piston slips 510 and 512. Anchor members 510 and 512 are in a common horizontal plane and are spaced 180 degrees apart. Another pair of identical anchor members are spaced below the anchor members 510, 512 as seen in FIG. 9. Any desired number of such anchor members may be provided, and they may be arranged with 2, 3, or 4 of them in a single horizontal plane. As can be seen, it is convenient to align them in vertical rows, as shown, to simplify manufacture and assembly or disassembly.

The body 502 is bored laterally for each anchor member as at 516 and the bore wall is made smooth to provide a good surface on which a seal ring is to slide while in sealing engagement therewith. For instance, the anchor member 510 is slidably received in lateral bore 516 and a seal ring, such as O-ring 518, is carried in a suitable external recess 520 where it is in continuous sealing contact with the inner wall of lateral bore 516. The bore 510, groove 520, and O-ring 518 in particular should be suitably lubricated.

Hold-down mechanisms as seen in FIGS. 2, 5, 6, and 7 are well known, the device 500 being improved in a manner to be described.

Lateral bore 516 communicates with longitudinal bore 504 of the anchor body 502 as shown. The diameter of the lateral bore in device 500 is shown to approximately equal the diameter of the longitudinal bore 504 and deep enough to intersect it.

The anchor members each are slidable in their respective bores between an initial retracted position and an expanded anchoring position. The anchor members are generally provided with opposing recesses such as recesses 524 and **524*a* formed in their exterior face, and similar recesses are formed in the exterial surface of body 502. (It may be desirable to continue the recess across the face of the slip.) Retaining springs 526 and 526*a* of the flat type are installed as shown and secured with screws 528 and 528*a***. These springs serve to maintain the anchor members fully retracted as shown until such time that anchoring is to take place. At that time, pressurization of the force generator is brought about. Pressure at that time acts against the inner side of the anchor members, each of which is, in effect, a piston, and forces them outward in opposition to the bias of the flat springs which tend to retract them.

The outer face of the anchor members is provided with teeth 70 for bitingly engaging the inner wall of the flow conduit in which the force generator is used.

Since anchor device 500 may be used in flow conduits having bores considerably larger than the outside diameter of body 502, the anchor members must be provided with a relatively long stroke, yet they must be fully retractable to avoid dulling of their teeth which would otherwise occur should they protrude from the housing as they are run into or out of the well. Also, it may be preferable to provide anchor members having toothed areas which are large. But large anchor members have shorter strokes, generally.

The improvement in hold-down devices mentioned earlier will now be described.

In order to provide large anchor members having strokes, the inward portion of the anchor member may be formed as shown in FIG. 10. It is readily seen that the inner end portion of anchor member 510 has been cut away arcuately as at 530 so that although the anchor member is fully retracted its inner end does not interfere with bore 504 of body 502. This change, of course, requires that the seal ring recess 520 be also curved, as seen in FIG. 9 if a maximum stroke is to be provided. When this seal ring recess 520 is seen in a development view, see FIG. 11, it is seen to be sinusoidal. Thus, the stroke of anchor member is increased appreciably. It is noticed that the sinusoidal wave of FIG. 11 makes two complete cycles in 360 degrees. As seen in FIG. 11, at 0 degrees, 180 degrees, and, of course, 360 degrees, the seal recess 520 is at its minimum height in the illustration, and at 90 degrees and 270 degrees the seal recess is at its maximum height. The difference in the maximum and minimum height represents the increase in stroke length.

It is readily understood that each anchor member must be oriented with respect to the longitudinal axis of body 502. It is noticed that the recesses 524 and 524*a* are located parallel to the vertical axis of the anchor member and also parallel to the longitudinal axis of the body, while perpendicular to the teeth 70. The retaining springs 526 and 526*a* being engaged in the spring recesses of the body and in the recesses in the anchor members will definitely maintain the anchor members in proper orientation.

Figure 12:
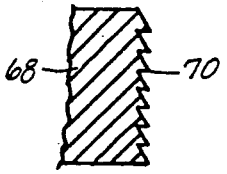
FIG. 12 is a vertical sectional view (in reduced scale) showing a profile of the teeth on the piston slip of FIG. 9.

As was mentioned earlier an anchor member 68 having hook-wall type teeth 70 as shown in FIGS. 2, 5, and 6 may be oriented as seen in FIG. 12 for use in a force generator for applying a pull or lifting force. Or, alternatively, such member can be rotated 180 degrees for use in supporting a force generator when exerting a push force.

Figure 13:
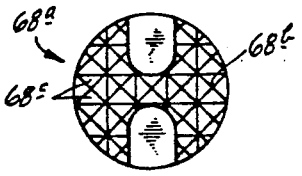
FIG. 13 is a full-face view (in reduced scale) of an alternate form of teeth on a piston slip.
Figure 14:
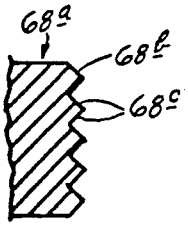
FIG. 14 is a sectional view showing the profile of the pyramidal teeth on the piston slip of FIG. 13.

In the case of the combination force generator 300 of FIG. 7 which can be used to pull or to push, the teeth of the anchor members may be formed as shown in FIGS. 13 and 14. In FIG. 13 the anchor member 69 may be provided with pyramidal teeth 69*b* having symmetrical faces 69*c* as shown. Thus, anchor members such as anchor member 69*a* will anchor against forces tending to displace them in either axial direction.

I claim:

1. A well tool for generating and applying an upward axial force to an object at a subsurface location in a well flow conductor, comprising:

(a) body means, including:

(i) an upper body member having a longitudinal bore extending therethrough and having means at its upper end for attachment to a handling string, (ii) pressure responsive means near the upper end of said upper body member for anchoring the same in said well flow conductor, (iii) piston means on said upper body member a spaced distance below said anchoring means, (iv) a lower body member having a longitudinal bore extending therethrough, an upper portion of said bore being enlarged and in which said piston means of said upper body member is reciprocable, said piston means providing in said cylinder means a power chamber and an exhaust chamber, including seal means for sealing between said piston means and said cylinder means and between said upper body member and said lower body member at both the upper and lower ends of said cylinder means, (v) means at the lower end of said lower body member for attachment thereto of an operating tool, (vi) means on said upper body member for conducting power fluid from said bore thereof into said power chamber, (vii) means on said lower body means for conducting fluids from said exhaust chamber, (viii) means on said piston and in said cylinder for limiting movement of said piston therein, and (ix) means for closing said bore of said lower body member below said piston means to permit building of fluid pressure thereabove for actuating said anchoring means and for actuation of said well tool, said lower body being provided with a seat in its lower portion, which seat is engageable by a ball closure member for permitting pressure to be built thereabove for actuation of said anchor means and said piston/cylinder means, and a spring associated with said seat for holding said ball closure member off said seat until the downward flow of fluids past said ball closure member is sufficient to overcome said spring and cause seating of said ball closure member.

2. A well tool for generating an upward axial force and applying it to an object at a subsurface location in a well flow conductor, comprising:

(a) upper tubular body means having a longitudinal bore extending therethrough, including:

(i) means at its upper end for attachment to a handling string, (ii) pressure responsive means near its upper end for anchoring the same in said well flow conductor, (iii) piston means intermediate its ends and including a piston carried thereon and extending outwardly thereof, and seal means carried on and surrounding said piston, and (iv) lateral flow passage means through the wall of said upper body means adjacent the upper side of said piston; and (b) lower tubular body means having a longitudinal bore extending therethrough, including:

(i) a cylinder near its upper end provided by an enlargement in its bore, said cylinder receiving said piston in sliding relation when said upper and lower body means are assembled in telescoping relation, said piston providing with said cylinder a power chamber and an exhaust chamber, said power chamber being communicated with the bore of said upper body means through said flow passage adjacent said piston, the movement of said piston in said cylinder being limited by shoulder means formed in either end of said cylinder, (ii) passage means through the wall of said cylinder at the lower end thereof communicating said exhaust chamber with the exterior thereof, (iii) seal means sealing between said upper and lower body means at the upper and lower ends of said cylinder, and (iv) means for closing the bore of said lower body means below said piston and said cylinder to allow building pressure thereabove for actuating said anchoring means and for moving said piston in said cylinder, wherein said lower body means is provided with a seat in its lower portion and a ball is seatable on said seat for closing said bore to permit fluid pressure to be built up thereabove for actuating said well tool, said means for closing the bore of said lower body means being in the form of a velocity check valve; and (v) means at the lower end of said lower body means for attachment of an engaging tool thereto.

3. The device of claim 1, wherein said means for closing said bore of said lower body means is a wireline removable closure device secured below said piston means.

4. A well tool for running into a well on a handling string for generating a downward axial force and applying it to an object at a subsurface location in a well flow conductor, comprising:

(a) body means, including:

(i) an upper body member having a longitudinal bore extending therethrough, said bore being enlarged near its lower end to provide a cylinder, and means at its upper end for attachment to a handling string, (ii) pressure responsive means above said cylinder for releasably anchoring said upper body member in said well flow conductor; and (b) a lower body member having a longitudinal bore extending therethrough, and having piston means at its upper end slidably received in a cylinder of said upper body member, the upper side of said piston being exposed to fluid pressures in said handling string and the lower side of said piston being exposable to fluid pressures in said well flow conductor, the movement of said piston in said cylinder is limited by engagement with shoulder means formed in either end of said cylinder and means for controlling fluid flow in the bore of said lower body means below said piston and said cylinder to allow building pressure thereabove for actuating said anchoring means and for moving said piston in said cylinder, said means for closing the bore of said lower body means being in the form of a velocity check valve; and (c) means at the lower end of said lower body member for attachment thereto of an engaging tool.

5. The device of claim 4, wherein said means for closing said bore of said lower body means is a removable closure device secured below said piston means.

6. A well tool for running into a well on a handling string for generating an axial force and applying it to an object at a subsurface location in a well flow conductor for applying either a pulling force or a pushing force to an object in a well, said well tool comprising:

(a) an upper tubular body member having a longitudinal bore extending therethrough and having means at its upper end for attachment to a handling string, said upper body member further including:

(i) piston means intermediate its ends, and (ii) pressure activated means near its upper end for anchoring the same in said well flow conductor;

(b) a lower tubular body member having a longitudinal bore extending therethrough, means at its lower end for attachment of an engaging tool, and piston means at its upper end;

(c) a middle tubular member having a longitudinal bore extending therethrough, said bore being enlarged near its upper end providing an upper cylinder for receiving said upper piston for sliding movement therein, said piston dividing said upper cylinder into an upper power chamber and a lower exhaust chamber, said bore also being enlarged near its lower end providing a lower cylinder for receiving said lower piston for sliding movement therein, said piston dividing said lower cylinder into an upper power chamber and a lower exhaust chamber;

(d) means on said upper body member for conducting power fluid from its bore into said upper power chamber;

(e) means on said middle tubular member for conducting fluids from said lower exhaust chamber;

(f) means on said upper and lower tubular body members and said middle tubular member for limiting the movement of said upper and lower pistons in said upper and lower cylinders; and (g) said anchor means including piston slip means moveable radially outwardly by fluid pressure, and said fluid conducting means includes fluid passage means for conducting power fluid to said piston slip means for activating the same, said piston slip means each having a sinusoidal external annular seal recess formed therein, and a resilient seal carried in said sinusoidal recess.

7. The well tool of claim 6 wherein said fluid conducting means further includes port means in the wall of said upper body member above said upper piston thereof for conducting power fluid into said power chamber of said upper cylinder of said middle tubular member.

8. The well tool of claim 7, wherein seal means are provided for sealing between said upper piston and said upper cylinder, between said lower piston and said lower cylinder, and between said upper tubular member and said middle tubular member at both the upper end and the lower end of said upper cylinder.

9. The well tool of claim 8, including means for closing said bore of said lower body member to permit pressurization of said handling string for activation of said well tool.

10. The well tool of claim 9, wherein said means for closing said bore of said lower body member is a seat engageable by a ball valve for closing the bore of said lower body member to permit pressurizing the handling string to actuate said anchor means and to move at least one of said upper and lower pistons in its respective cylinder.

11. The well tool of claim 10, wherein means are provided for biasing said ball away from said seat to permit fluid to flow therepast until a predetermined fluid flow rate obtains, at which time the flow resistance of the ball will cause it to become seated on said seat to stop such fluid flow therepast.

12. The well tool of claim 9, wherein said closing means is a velocity check valve.

13. The well tool of claim 9, wherein said closing means is a removable closure device secured at a location below said lower piston.

14. A system for moving an object axially in a well flow conductor, comprising:

(a) a handling string comprising a length of reeled tubing, said reeled tubing having a first end and a second end, said first end being connectable to a force generator and said second end being connectable to a source of fluid pressure, said force generator having anchoring means near its upper end, object engaging means at its lower end, and piston/cylinder means in between for changing the distance between said anchor means and said object engaging means;

(b) means for inserting said first end of said handling string into said well and for moving said handling string into and out of said well, said second end of said handling string remaining at the surface;

(c) means for forcing pressurized fluid into said handling string while said handling string is in said well;

(d) means on the lower end of said force generator for engaging said object to be moved axially in said well;

(e) whereby the handling string, having said force generator and said object engaging means on its lower end, may be run into a well until said object is engaged, after which the handling string is pressurized by forcing fluid thereinto at the surface to activate said anchoring means in said flow conductor and to actuate said force generator to apply an axial force to said object for moving the same axially in the well; and (f) wherein said object is a sliding sleeve device forming a portion of said flow conductor and comprising a housing having a lateral port through its wall and a sliding sleeve therein slidable between port opening and port closing positions, and said engaging means is a shifting tool compatible with said sliding sleeve device for engaging and shifting the sleeve between its open and closed positions.

15. The system of claim 14, wherein said means for changing the distance between said anchoring means and said engaging means lengthens said distance to shift said sleeve downward.

16. The system of claim 14, wherein said means for changing the distance between said anchoring means and said engaging means shortens said distance to shift said sleeve upward.

17. The system of claim 14, wherein said means for changing the distance between said anchoring means and said engaging means selectively lengthens or shortens said distance.

18. The system of claim 14, wherein said means for changing the distance between said anchoring means and said engaging means selectively lengthens or shortens said distance.

19. A system for moving an object axially in a well flow conductor, comprising;

(a) a handling string comprising a length of reeled tubing, said reeled tubing having a first end and a second end, said first end being connectable to a force generator and said second end being connectable to a source of fluid pressure, said force generator having anchoring means near its upper end, object engaging means at its lower end, and piston/cylinder means in between for changing the distance between said anchor means and said object engaging means;

(b) means for inserting said first end of said handling string into said well and for moving said handling string into and out of said well, said second end of said handling string remaining at the surface;

(c) means for forcing pressurized fluid into said handling string while said handling string is in said well; and (d) means on the lower end of said force generator for engaging said object to be moved axially in said well;

(e) whereby the handling string, having said force generator and said object engaging means on its lower end, may be run into a well until said object is engaged, after which the handling string is pressurized by forcing fluid thereinto at the surface to activate said anchoring means in said flow conductor and to actuate said force generator to apply an axial force to said object for moving the same axially in the well;

(f) wherein said object to be moved is a body lodged in the bore of said flow conductor, said means for engaging said object is a tool suitable for pushing, and said means for changing the distance between said anchoring means and said engaging means lengthens said distance.

20. An anchoring device for anchoring an inner string of jointed or reeled tubing in a well flow conductor such as tubing or casing at a downhole location, said anchoring device comprising:

(a) body means attachable to said inner string, said body means having an axial flow path therethrough for fluidly communicating with said inner string and at least one lateral bore fluidly communicating with said axial flow path;

(b) an anchor member, having an inner end and an outer end carried in each of said at least one lateral bore and being movable from a retracted to an expanded position responsive to application of pressurized fluid thereto from the surface through said inner string, said axial flow path, and said lateral bore, to anchoringly engage the inner wall of said well flow conductor, each said anchor member being formed with an external recess thereabout near its inner end;

(c) means on said body means engageable with said anchoring member for biasing the same toward retracted position;

(d) wherein said external recess of said anchor member being formed along a path curved about the axis of said axial flow path when said anchor member is assembled in said lateral bore of said body means; and (e) a resilient seal member carried in said external recess of said anchor member for sealing therearound.

21. The device of claim 20, wherein means are provided for retaining said anchoring member oriented in said lateral bore.

22. The device of claim 21, wherein said means for orienting said anchor member is recess means in the outer end face of said anchor member engageable by a retainer carried on said body.

23. The device of claim 21, wherein said means for biasing said anchor member toward retracted position is flat spring means attached to said body means.

24. The device of claim 23, wherein said flat spring means is engaged in said recess in the outer end face of said anchor member to maintain it oriented with respect to said body means.

25. The device of claim 23, wherein said flat spring means are secured to said body by screws, and said body is formed with recesses in its exterior surface for receiving both said springs and said screws, whereby said springs and screws will not project beyond the periphery of said body means when said anchor members are retracted.

26. The device of claim 25, wherein said lateral bore of said body is formed with shoulder means for limiting inward movement of said anchor member therein.

27. The device of claim 26, wherein the inner end of said anchor member is formed with a recess extending across its inner end in a direction parallel to said longitudinal bore of said body means when said anchor member is assembled in said lateral bore of said body means to permit retraction thereof to a position which would interfere with the longitudinal bore of said body means were the piston slip not so recessed across its inner face.

* * * * *